US009528809B1

(12) United States Patent
Cahayla et al.

(10) Patent No.: US 9,528,809 B1
(45) Date of Patent: Dec. 27, 2016

(54) BRIDGEWIRE SHUNT SETBACK SWITCH

(71) Applicants: Jason R. Cahayla, West Milford, NJ (US); Stephen Redington, Wharton, NJ (US); Barry Schwartz, Newton, NJ (US); Lloyd Khuc, Wharton, NJ (US)

(72) Inventors: Jason R. Cahayla, West Milford, NJ (US); Stephen Redington, Wharton, NJ (US); Barry Schwartz, Newton, NJ (US); Lloyd Khuc, Wharton, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/842,269

(22) Filed: Sep. 1, 2015

(51) Int. Cl.
*F42C 15/24* (2006.01)

(52) U.S. Cl.
CPC ..... *F42C 15/24* (2013.01)

(58) Field of Classification Search
CPC ..... F42C 1/00; F42C 1/02; F42C 1/04; F42C 15/24
USPC ..... 102/202.1, 202.2, 202.3, 216, 247
See application file for complete search history.

(56) References Cited

U.S. PATENT DOCUMENTS

| | | | | | |
|---|---|---|---|---|---|
| 2,827,851 | A * | 3/1958 | Ferrara | F42C 11/02 | 102/210 |
| 3,086,468 | A * | 4/1963 | Mountjoy | F42C 15/24 | 102/216 |
| 3,572,247 | A * | 3/1971 | Warshall | F42B 3/188 | 102/202.2 |
| 4,085,679 | A * | 4/1978 | Webb | F42C 15/184 | 102/256 |
| 4,515,080 | A * | 5/1985 | Bell | F42B 3/113 | 102/205 |
| 4,599,945 | A * | 7/1986 | Groustra | F42C 7/12 | 102/256 |
| 4,667,598 | A * | 5/1987 | Gröbler | F42C 11/00 | 102/215 |
| 4,715,281 | A * | 12/1987 | Dinger | F42C 19/06 | 102/216 |
| 4,953,475 | A * | 9/1990 | Munach | F42C 15/30 | 102/228 |
| 5,131,328 | A * | 7/1992 | Chan | F42C 15/24 | 102/229 |
| 5,485,788 | A * | 1/1996 | Corney | F42C 11/02 | 102/202.1 |

* cited by examiner

*Primary Examiner* — Bret Hayes
(74) *Attorney, Agent, or Firm* — Michael Sachs

(57) ABSTRACT

A setback switch device is provided which, upon launch, can arm an explosive or pyrotechnic device for military gun launched applications. An included bridgewire shunt feature can also prevent the unintended arming, or accidental arming by a stray voltage before any launch is undertaken, of such explosive or pyrotechnic device.

8 Claims, 3 Drawing Sheets

BRIDGEWIRE SHUNT SETBACK SWITCH

U.S. GOVERNMENT INTEREST

The inventions described herein may be made, used, or licensed by or for the U.S. Government for U.S. Government purposes.

BACKGROUND OF INVENTION

The initiation of explosive and pyrotechnic devices for military gun launch applications require the use of a device that will prevent unintended functioning of the initiating element until conditions are safe to do so. Existing solutions for this type of application are complex, bulky and expensive for ballistic applications that do not require a traditional safe and arm device when explosive devices are not being initiated. Rocket motors or propelling charges are examples of such applications. In these cases a low cost and inherently robust device is preferred such that the device cannot unintentionally react during handling or the erroneous operation of electronic circuits designed to function the energetic elements.

The old ways of solving the problem are well known and include conventional safe and arm devices. These devices are bulky and expensive. Alternatively, the design may not provide a safety feature at all since the safety requirements for non-explosive elements may be lax, poorly understood or undefined. This increases the potential of inadvertently initiating the device under certain circumstances. Such was the case when a Navy rocket motor was accidentally initiated on the USS Forrestal in 1967 with disastrous results.

BRIEF SUMMARY OF INVENTION

The invention described herein is manufactured using simple methods and provides an electrically conductive, normally closed circuit that is wired in parallel with the bridgewire. The proposed device has far less of an electrical resistance that than of the attached bridgewire and therefore diverts the majority of any electric current through the shunt in the event of an unintentional initiation. During a setback type event, the shunt device destructively breaks which in effect removes the shunt portion of the circuit for the main circuit which then allows the full electrical current to be diverted to the bridgewire circuit for full current initiation of the bridgewire.

OBJECTS OF THE INVENTION

Accordingly, it is an object of the present invention is to provide a setback switch device which, upon launch, can arm an explosive or pyrotechnic device for military gun launched applications.

Another object of the present invention is to provide a bridgewire shunt means which can prevent the unintended arming, before any launch is undertaken, of an explosive or pyrotechnic device in military gun launched applications.

It is a further object of the present invention to provide a bridgewire shunt means which can prevent the accidental arming by a stray voltage of an explosive or pyrotechnic device.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
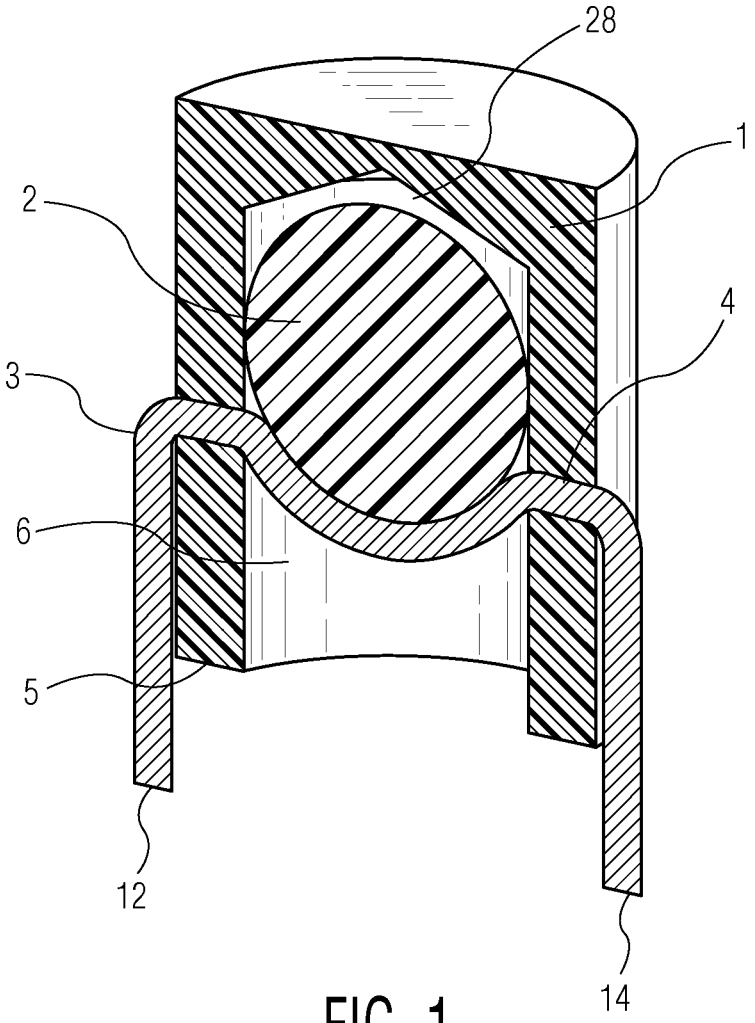
FIG. 1 is an isometric cutaway drawing showing the bridgewire shunt setback switch device according to this invention.
Figure 2:
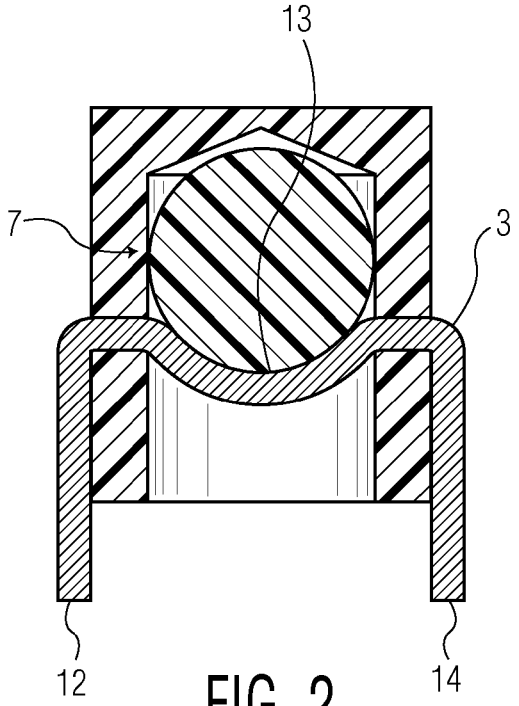
FIG. 2 shows a cross section view of the bridgewire shunt setback switch device, at rest and before activation, according to this invention.

As might be seen in FIGS. 1-5, (particularly FIG. 4), in explosive and/or pyrotechnic devices for military gun launched applications of this invention, when a bridgewire 22 is activated by voltage 20, the munition will become armed. It is imperative that bridgewire 22 not become activated until intended (such as at launch), inadvertently or accidentally, for that would be an extreme danger. Therefore as a protection against that, the bridgewire 22 is permanently shorted by a shunt wire 3 (see FIGS. 1-3, for example), as may be seen also as element 23 in FIG. 4, e.g. Thus, the bridgewire 22 can never be activated unless shunt wire 3 is somehow removed (or broken). This can only happen, hopefully, upon an intended launch, through use of the safety device of this invention. Then, without shunt wire 3 interfering, a current will flow through bridgewire 22 from voltage source 20 down to ground 21, and the munition will become armed. In a physical embodiment of the switch according to the invention, the bridgewire shunt setback switch device of FIG. 1 includes a housing 1, ball mass 2, and shunt wire 3. The housing 1 is comprised of, but not limited to, a non-conductive material which may be manufactured from a plastic material. The housing 1 provides a means of containing all elements together in a non-electrically conductive environment. Housing 1 also provides a bottom surface feature, housing base 5, for which to mount the device on a flat surface such as that of a circuit board, and a defined inside upper area 28. The housing may be made of a magnetic material or be magnetic.

The ball mass 2 shown in this device is constructed of but not limited to, a non-conductive element that will provide the necessary axial force under acceleration force 9 to directly apply a bias force against shunt wire suspension 13 and cause it to break when a particular ultimate tensile force is achieved. The ball mass 2 is a movable element that is able to translate axially in housing 1 along housing bore 6. The ball mass may be made of plastic, or it may be of a magnetic material or be nonmagnetic. Shunt wire 3 is an electrically conductive element that is held in suspension in housing 1 via two through holes wire port 4. The shunt wire may be a straight piece of wire that has essentially zero electrical resistance. The shunt wire may have a nonelectrically conductive outer coating. Wire port 4 on both sides of housing 1 permit the wire to span thru housing 1 and provide a fixed height for the shunt wire 3 to be supported on either side of housing 1 and provide axial restraint for ball mass 2 while at rest. The housing wire ports may be such that both holes are positioned at the same height above the bottom area, and may be approximately 180 degrees apart if looking at a horizontal cross section of such housing. The ball mass 2 is intimately situated against shunt wire 3 as shown explicitly as shunt wire suspension 13 to provide a nest-like captive assembly to prevent excessive axial movement of ball mass 2 along housing bore 6. Ball mass 2 is also constrained from radial movement by the sides of housing bore 6. The ball mass may take a number of shapes, so long as it can be suspended by the shunt wire only.

Figure 3:
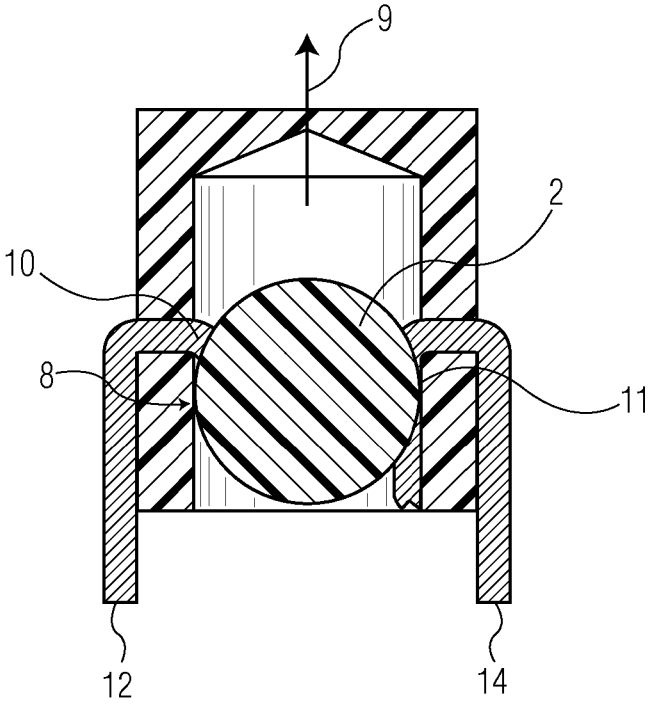
FIG. 3 shows a cross section view of the bridgewire shunt setback switch device, following its activation upon launch, according to this invention.

FIG. 3 illustrates the effects of an acceleration force 9 on the device. While under acceleration, ball mass 2 and shunt wire 3 have opposite force induced and movement relative to one another, due to not instantly overcoming at rest inertia of the ball mass when the device including the fixed shunt wire suddenly accelerates. If the acceleration is of sufficient magnitude, such as a gun launch of a projectile, the force of ball mass 2 transmitted to shunt wire suspension 13 will be sufficient to overcome the ultimate tensile strength of shunt wire 3, thereby breaking such as shown at wire break 10, which in effect creates an open circuit situation between wire end 12 and wire end 14, and allows ball mass 2 to translate axially from initial position 7 to final position 8 thereby creating an open circuit situation to the electronics. The shunt wire 3 may break and be shredded at one or more places during this acceleration event. Referring to FIG. 3, once ball mass 2 has translated fully downward to final position 8 during the acceleration event, shunt wire 3 may be broken and trapped between the housing 1 and ball mass 2 creating a ball mass binding 11 situation that helps to contain the ball mass 2 in final position 8. This inherent locking in the downward position helps to prevent wire break 10 from reconnecting the wire electrically.

Figure 4:
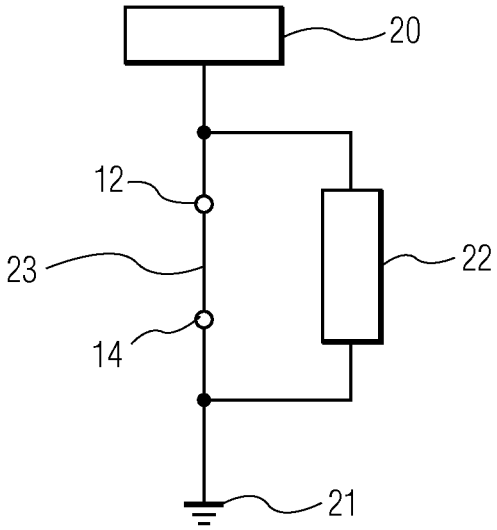
FIG. 4 shows an electrical schematic of the wiring of shuntwire and the bridgewire shunt setback switch device, at rest and before activation, according to this invention.

FIG. 4 illustrates the normally closed state of the switch which is shown to be in a parallel electrical circuit configuration with Bridge wire 22 as shown in FIG. 4. The circuit may be powered by voltage source 20 down to a ground 21, however this power is only intended to be applied in the event of an actual launch. (The voltage source 20 may be direct current, or it could generate alternating current, or some other type of electrical waveform). In the event the voltage source were applied inadvertently when there is not actually an intended launch, then essentially all the electric current flows through the shunt wire, which acts as a straight wire to short the Bridge Wire. (Typically, a bridgewire has a higher electrical resistance than the shunt wire, so if an electrical load were applied across the circuit, the majority of electrical current would be biased to go across the shunt wire electrical path 23 and therefore not have a tendency to travel across bridgewire 22, which in effect prevents the bridgewire 22 from functioning).

Figure 5:
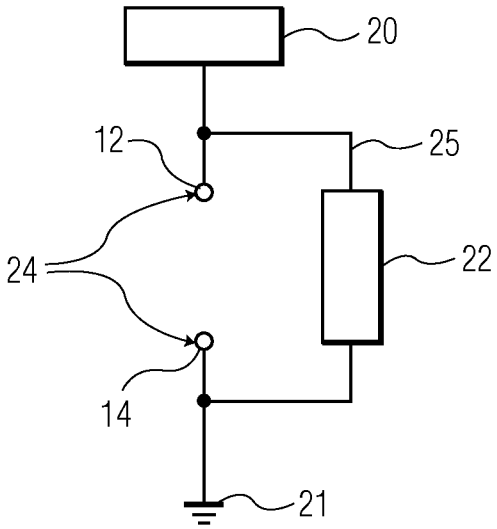
FIG. 5 shows an electrical schematic of the wiring of shuntwire and the bridgewire shunt setback switch device, following its activation upon launch, according to this invention.

FIG. 5 illustrates the state of the electrical circuit after acceleration force 9 has been applied to the device. This illustration is shown after the ball mass 2 has caused the shunt wire to break as in shunt wire breakage 24, whereas the shunt no longer provides a biased path for the electrical current to flow. All of the electrical current is therefore diverted and forced to flow through bridgewire 22 along bridgewire electrical path 25. This state of the device allows the bridgewire 22 to be initiated by an electrical pulse such as by voltage source 20 and ground 21 as shown in FIG. 5.

While the invention may have been described with reference to certain embodiments, numerous changes, alterations and modifications to the described embodiments are possible without departing from the spirit and scope of the invention as defined in the appended claims, and equivalents thereof.

What is claimed is:

1. An arming means for explosive and/or pyrotechnic devices for military gun launched applications; said arming means comprising:

a plastic housing having a central bore region, a closed upper area and a base area, said housing having two oppositely placed through holes, and;

a voltage source which includes a ground point and a voltage source output;

a shunt wire of negligible electrical resistance, physically positioned through both holes, and;

a nonelectrically conductive ball mass sized to fit inside the housing and translate within the housing central bore region, and wherein the ball mass is further sized so that said ball mass is supported on said shunt wire, and;

a bridgewire used to arm the explosive and/or pyrotechnic device when sufficient current flows through said bridgewire, said bridgewire electrically in parallel circuit with said shunt wire, said parallel circuit being connected between the voltage source output and the ground point and whereby said shunt wire normally diverts all the electrical current there through to short said bridgewire, and wherein;

during launch, upon rapid acceleration of said explosive and/or pyrotechnic device including said arming means, at rest inertia of the ball mass acting against the accelerating shunt wire will break said shunt wire and stop current flow there through, and;

whereas current stoppage in said shunt wire enables voltage source current to flow only through said bridgewire, and thus will arm said explosive and/or pyrotechnic device, and;

wherein the ball mass will become wedged in the base area by broken shunt wire shreds, and maintain the broken shunt wire shreds thereafter in said base area.

2. The arming means of claim 1 where the ball mass is plastic.

3. The arming means of claim 1 where the shunt wire has electrical insulation.

4. The arming means of claim 1 where the voltage source is direct current.

5. The arming means of claim 1 where the voltage source is alternating current.

6. The arming means of claim 1 where the housing is nonmagnetic.

7. The arming means of claim 6 where the ball mass is nonmagnetic.

8. The arming means of claim 1 where the ball mass is nonmagnetic.

* * * * *